US005239980A

United States Patent [19]

Hilt et al.

[11] Patent Number: 5,239,980

[45] Date of Patent: Aug. 31, 1993

[54] FORCED AIR FURNACE CONTROL SYSTEM AND METHOD OF OPERATION

[76] Inventors: Fay E. J. Hilt; James W. E. Locke, both of P.O. Box 1329, Freedom, Calif. 95019

[21] Appl. No.: 885,507

[22] Filed: May 19, 1992

[51] Int. Cl.[5] ..... F23N 5/24; F24H 3/00

[52] U.S. Cl. ..... 126/116 A; 431/16; 431/22

[58] Field of Search ..... 431/2, 16, 18, 22, 76; 126/116 A; 237/5, 12.4, 12.3 C

[56] References Cited

U.S. PATENT DOCUMENTS

| | | | |
|---|---|---|---|
| Re. 30,936 | 5/1982 | Kmetz et al. | 431/22 |
| 2,532,214 | 11/1950 | Willenborg | 431/76 X |
| 2,757,362 | 7/1956 | Gutkowski | 431/22 |
| 3,582,247 | 6/1971 | Faure | 431/22 |
| 4,171,944 | 10/1979 | Hirschmann | 431/22 |
| 4,221,206 | 9/1980 | Haas | 123/198 |
| 4,525,137 | 6/1985 | Tomioka et al. | 431/76 |
| 4,534,727 | 8/1985 | Imajima | 431/76 |
| 4,561,288 | 12/1985 | Moenkhaus | 73/23 |
| 4,682,156 | 7/1987 | Wainwright | 340/603 |
| 4,715,214 | 12/1987 | Tveter et al. | 73/49 |
| 5,039,006 | 8/1991 | Habegger | 431/22 X |

FOREIGN PATENT DOCUMENTS

| | | | |
|---|---|---|---|
| 0138654 | 6/1987 | Japan | 126/116 A |
| 0003123 | 11/1988 | Japan | 431/22 |
| 0057695 | 11/1988 | Japan | 431/22 |

*Primary Examiner*—Carl D. Price

*Attorney, Agent, or Firm*—Flehr, Hohbach, Test, Albritton & Herbert

[57] ABSTRACT

A forced air furnace control system for preventing the buildup of dangerous concentrations of CO gas within a building airspace. A CO sensor is mounted in the air exit plenum of the furnace and connected in a circuit which produces an output signal when the concentration of CO gas in the plenum reaches a predetermined unsafe level. A disable control signal is then triggered through the circuit for switching the furnace to its nonoperating mode. A latch circuit is provided for latching the furnace control in the nonoperating mode independent of the disable control signal. A reset circuit is provided to manually override operation of the latch circuit and re-enable the furnace control for switching to the operating mode.

6 Claims, 2 Drawing Sheets

FORCED AIR FURNACE CONTROL SYSTEM AND METHOD OF OPERATION

BACKGROUND OF THE INVENTION

1. Field of the Invention

This invention relates in general to forced air furnaces of the type used for residential and office building heating, and more particularly relates to systems for controlling operation of forced air furnaces.

2. Description of the Prior Art

The prior art commercial and residential forced air heating systems employ a heat exchanger which separates the furnace combustion chamber from the path of air leading to rooms or other spaces in the building which are to be heated. During normal operation, the heat exchanger provides a barrier preventing escape of the combustion products into the air flow. Cracks or other defects in the heat exchanger can release the combustion products into the air flow and building airspace. Components of the combustion products which are poisonous to humans, principally CO gas, is detrimental to health, and in many cases causes death to the building occupants. Because CO gas is colorless and odorless, the occupants are oftentimes unaware of the problem and can become asphyxiated. Among the prior art attempts to provide occupants with warning of abnormal furnace operation is U.S. Pat. No. 4,171,944 to Hirschmann. The patent provides a smoke detector electrically connected to shut a furnace down when excessive smoke escapes into the room containing the furnace. U.S. Pat. No. Re. 30,936 to Kmetz provides a temperature-dependent control system which senses air temperature in exhaust ducting to cut out the burners of a furnace when the exhaust gases are too hot. U.S. Pat. No. 3,582,247 to Faure provides a system for shutting a boiler down when leaks of combustible fluid are detected. U.S. Pat. No. 4,715,214 to Tveter detects leakage from a pressurized system by sensing and calculating differences in gas pressure values. U.S. Pat. No. 4,221,206 to Haas relates to automobile systems and provides a system for shutting off an internal combustion engine responsive to carbon monoxide detectors.

OBJECTS AND SUMMARY OF THE INVENTION

It is a general objection of the present invention to provide a forced air heating system with improved safety features preventing buildup of dangerous concentration of noxious gases within a building airspace.

Another object is to provide a safety control system which continuously monitors the presence of CO gas in the air exit plenum of a forced air furnace and automatically shuts the furnace down when the CO concentration is unsafe.

Another object is to provide a safety control system of the type described which reacts to the presence of CO in the air flow from a forced air furnace before the CO concentration in the building airspaces reaches unsafe levels.

Another object is to provide a safety control system of the type described in which the CO sensor element is in the furnace exit air plenum where the heated air is dry to obviate the problem of relative humidity interference with the sensor.

Another object is to provide a safety control system of the type described in which the CO sensor element is positioned in the air flow from the furnace where the gas concentration is relatively much higher than in the building airspace so that CO detector sensitivity is less difficult to achieve.

The invention in summary provides a safety control system and method of operation in which a CO gas sensor is placed in the air exit plenum which is downstream in the flow of heated air from a forced air furnace. The control system includes means for producing an output signal when the sensor detects that the concentration of CO gas in the plenum reaches a predetermined unsafe level. Control circuit means then triggers a disable control signal responsive to the output signal, and disable circuit means connected with the furnace control circuit switches the furnace to a nonoperating mode. Latch circuit means is provided to thereafter maintain the furnace in its nonoperating mode independent of the disable control signal. A reset circuit is also provided to selectively override operation of the latch circuit means and re-enable control of the furnace in its operating mode.

The foregoing and additional objects and features of the invention will appear from the following specification in which the several embodiments have been set forth in detail in conjunction with the accompanying drawings.

DETAILED DESCRIPTION OF THE PREFERRED EMBODIMENTS

Figure 1:
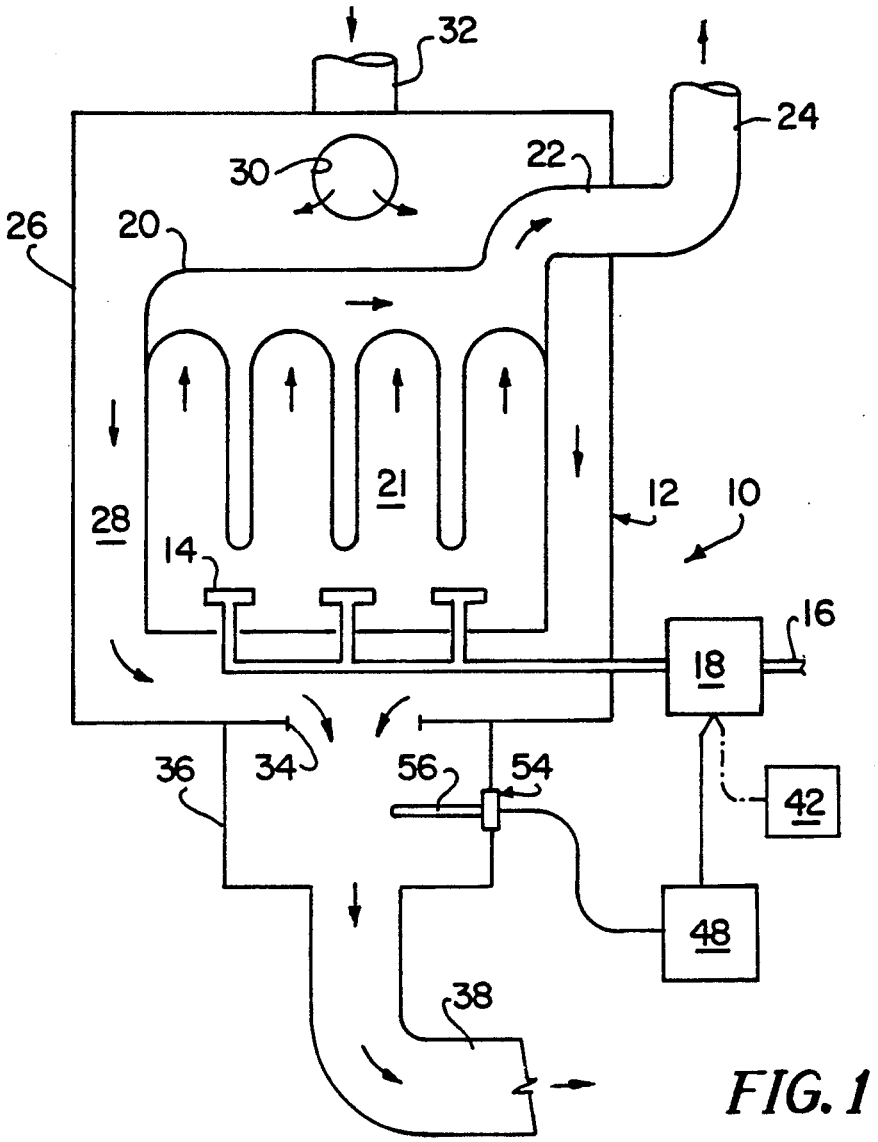
FIG. 1 is a schematic view illustrating a forced air furnace system in accordance with a preferred embodiment of the invention.
Figure 2:
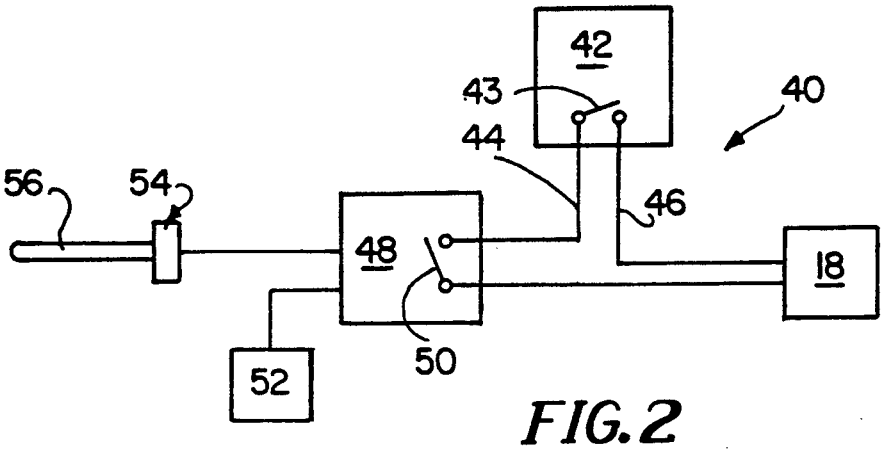
FIG. 2 is a schematic block circuit diagram illustrating components of the control system for the forced air furnace system of FIG. 1.

In the drawings FIG. 1 illustrates generally at 10 a forced air furnace system incorporating a preferred embodiment of the invention for use in heating airspaces of a building, such as a commercial or residential building. The system includes a furnace 12 which can be of conventional design comprising open flame burners 14 which burn a fuel, such as natural gas, received from supply line 16 under influence of furnace control valve 18. A heat exchanger 20 forms a combustion chamber 21 for confining the gaseous combustion products. Normally the combustion products flow upwardly into a flue 22 which exists through a wall of the furnace and into a stack 24 for exhaust from the building. A box-shaped outer furnace housing 26 encloses an air chamber 28 around the heat exchanger, and an opening 30 connected with a conduit 32 directs inlet air into the chamber. At the bottom of the furnace housing an opening 34 directs heated air into an exit air plenum 36. Hot air is directed from the plenum along ducting 38 to the airspaces in the building which are to be heated. FIGS. 1 and 2 illustrate schematically a circuit 40 of the furnace control system. The control system incorporates a conventional building thermostat 42 which normally controls on-off operation of the furnace for regulating airspace temperatures. The thermostat which is installed as original equipment with the furnace can be used by connecting circuit components in series with the thermostat contact switch 43. The control system of the invention can thereby be retrofit into an existing furnace system. Alternatively, the control system can be incorporated in the design of a furnace system as original equipment. Thermostat contact switch 42 shown in FIG. 2 connects in series through a pair of wires 44, 46 with furnace control 18. Details of the thermostat and furnace control are conventional and are not shown in the drawings for purpose of clarity. In the operating mode of the furnace, thermostat contact switch 43 is closed.

Figure 3:
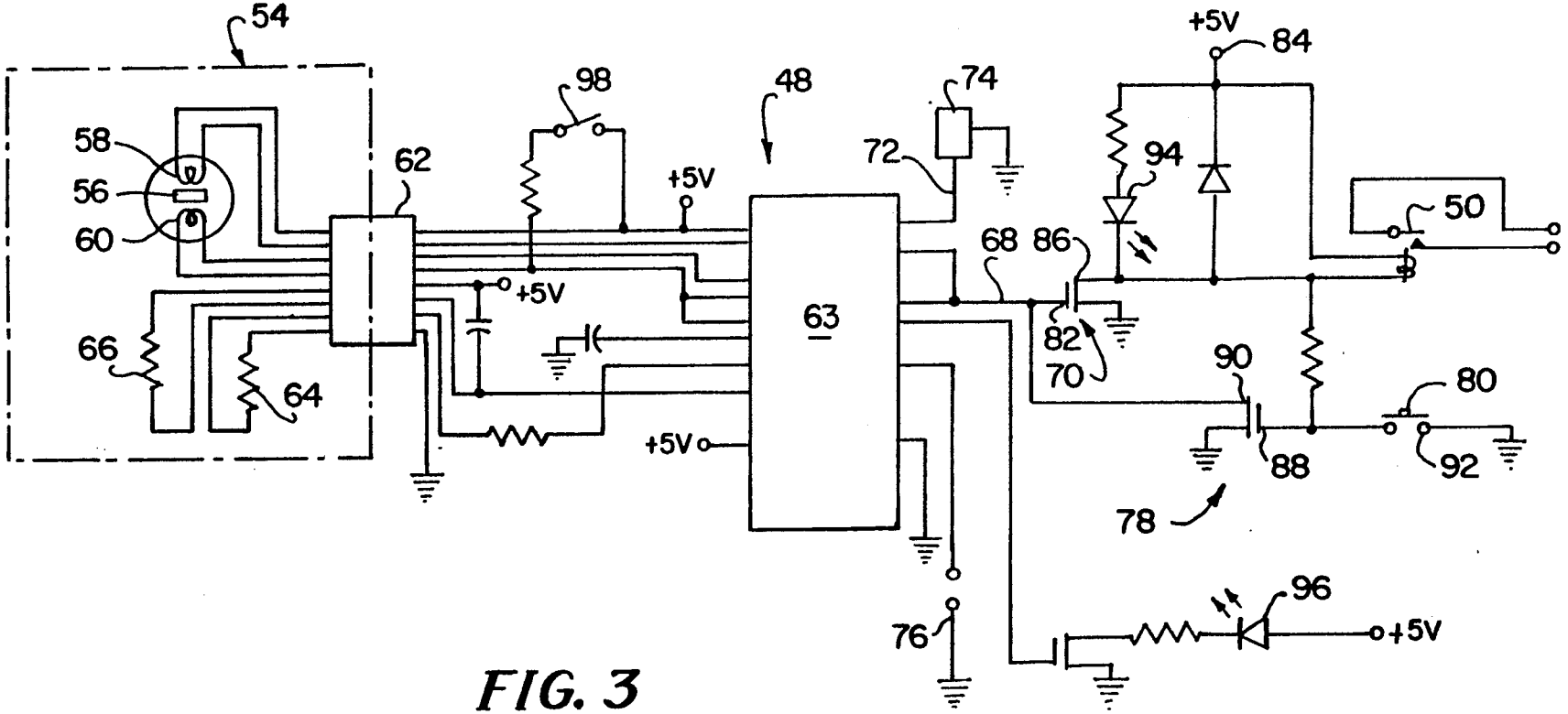
FIG. 3 is a schematic circuit diagram illustrating details of certain components of the circuit diagrammed in FIG. 2.

The invention provides a control circuit 48 shown generally in the block diagram of FIGS. 1 and 2 in detail in the schematic of FIG. 3. The control circuit includes a relay 50 which is connected in series with one of the wires 44 7hich interconnects furnace control 18 with thermostat 42. The contacts of relay 50 are closed to enable the furnace for its operating mode. When the relay contacts are open, furnace control 18 is switched off and the furnace is shut down. Power supply 52 provides electric power to the control circuit.

A carbon monoxide (CO) sensor 54 is mounted on one side wall of exit air plenum 36 with the active sensor element 56 projecting into the path of air flow through the plenum. This location for the CO sensor element provides a number of important advantages. From a safety standpoint, the plenum location enables detection of any buildup of CO to a harmful level before the CO concentration in the building airspace increases. Next, CO concentration in the plenum is at least two times higher than that in the building airspace, making is possible to achieve greater CO detection sensitivity. With the CO sensor placed in the plenum where the air has just passed through the heat exchanger, a relatively high concentration of CO would exist if there is a crack or other failure in the heat exchanger permitting release of combustion products from chamber. Also, air in the plenum has been heated to the point that it is quite dry with low relative humidity, thereby reducing the problem of relative humidity interference with the sensor. Another advantage from an installation standpoint is that the plenum wall typically affords a convenient location for installation of the detector in the housing which contains the supporting electronics.

Sensor 54 can be of conventional design adapted for sensing concentrations of CO gas in an air atmosphere. The sensor sold under model number TGS203 by the Figaro Company, or its equivalent, is suitable for use in the invention.

Details of sensor 54 are shown schematically in FIG. 3. A tin oxide tube 56 is contained within the sensor body. A pair of heater wires 58, 60 are mounted within the sensor body and connected through leads to a cable connector 62. Resistance heating of the wires heats the tin oxide tube for degassing the sensor by driving off water and other volatile components on its surface. The sensor operates on the principle that tin oxide in a reducing atmosphere, such as a gas with CO, will reduce and give up oxygen. The tin oxide becomes more conductive as oxygen is given up. A suitable IC chip 63 is coupled through connector 62 to control the sensor to operate in successive detect cycles of 2½ minutes duration. Each cycle comprises a heating phase of approximately 90 seconds when the tin oxide is degassed and then cooled. In the next phase of approximately 60 seconds the air, with any entrained CO, comes into contact with the sensor. The CO causes the tin oxide to lose oxygen and become slightly more conductive. In the final phase of the cycle this conductivity is compared with a reference level by means of a resistor 64 which is controlled by chip 64. The resistance of the tin oxide goes up as the oxygen is driven off. Resistor 66 is connected in the circuit to provide temperature compensation.

IC chip 63 contains conventional logic circuits which are programmed in accordance with known techniques to operate sensor 54 through its sequential detect cycles. Chip 63 also includes suitable internal comparator circuits which are programmed in accordance with conventional techniques to compare the magnitude of change in conductivity of the tin oxide tube in relation to a known change in conductivity that would result from a CO concentration which has been determined to be unsafe. A CO concentration of 200 ppm is established as the unsafe level in the explanation of the present invention, although this level could vary depending upon particular operating conditions. When IC chip 63 determines that the concentration of CO gas within the plenum being sensed by the gas sensor reaches the predetermined unsafe level, a disable control signal is generated by applying a high signal into line 68 leading to field effect transistor 70 as well as line 72 leading to buzzer alarm 74. The CO concentration level at which the disable control signal is triggered can be adjusted between two levels by either installing or removing a jumper in line 76 between the IC chip and ground. The circuit can be calibrated for the desired concentration levels by testing the sensor in atmospheres of known CO concentrations.

Control circuit 48 includes a second field effect transistor 78 which is coupled with transistor 70 by the circuit shown in FIG. 3 so that the two transistors can cooperate to latch out relay 50 for maintaining the furnace in its nonoperating mode independent of the disable control circuit and until a reset button 80 in the circuit is pushed.

During normal furnace operation when sensor 54 operates to sense that the CO concentration in the plenum is below the unsafe level, then IC chip 63 drives the pin 82 of transistor 70 high, turning it on. Current then flows from the +5 V power supply at 84 through the coil of relay 50 to close its contacts and establish the circuit between building thermostat 18 and furnace control 42. When transistor 70 is on, its pin 86 is low, making pin 88 of transistor 78 low. This turns transistor 78 off. Therefore during normal furnace operation the transistor 70 is on while transistor 78 is off.

If the IC chip logic determines that the second CO concentration reaches an unsafe level, or if a line or cable is disconnected, the disable control signal from the chip causes pin 82 of transistor 70 to go low which in turn causes its pin 86 to go high to +5 V. This deactivates relay 50 and opens the circuit into furnace control 42 to disable the furnace. At the same time, the high on pin 86 of transistor 70 makes pin 88 of transistor 78 high. This causes pin 90 of transistor 78 to go low, which in turn holds pin 82 of transistor 70 low. This causes transistor 70 to latch and be held in its off state, preventing relay 50 from closing. The IC chip cannot pull pin 82 of transistor 70 back into its high state. In this condition of the circuit, transistor 78 can only be turned off by manually pushing reset button 80 to close contacts 92 for /verriding the latch and enabling furnace operation. After CO is detected in plenum 36, then for safety reasons this latch feature prevents the circuit from recovering without a manual reset.

A green LED 94 is provided in the circuit between +5 V power source 84 and pin 86 of transistor 70. When the furnace is enabled by the circuit, LED 94 is closed and green light is emitted, and when the furnace is disabled the LED is open and the light is off. Even if the circuit is latched out by transistors 70 and 78, if the green light is off then the furnace is still not enabled. The purpose of this is to permit the user to know when the reset button can be pushed to enable the furnace. If the reset is pushed and if everything is normal, then the green light will go on. Circuit 48 also includes a yellow LED 96 which is controlled by chip 63 to cycle on and off at 2½ minute intervals. A normally open test switch 98 is provided in the circuit for use in combination with the yellow LED to show that the circuit is working properly. If test switch 98 is closed then in no more than one measurement cycle of the sensor, buzzer alarm 74 should be activated and the furnace control should be disabled. Test switch 98 simulates the condition of the sensor detecting an unsafe concentration of CO, and the buzzer should sound in no more than one mesurement cycle. If the test switch is closed and yellow LED 96 goes through a complete on-off cycle without the buzzer sounding, then this provides an indication of a problem in the circuit. This permits the yellow LED to be used in the test process to verify that the test is complete.

It is a feature of the control circuit that buzzer alarm 74 goes off if the CO concentration is below the unsafe level even if relay 50 is latched out. Therefore the buzzer alarm gives an on-line "CO exceeded" signal even if the furnace is shut down. This helps the user determine if CO has been eliminated as the source of any problems in the furnace system. For example, should be buzzer stay on after the furnace has been shut down for a time sufficient to dissipate the CO concentration, then this would tell the user that the problem is in the circuit and not that of CO leakage.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. Forced air furnace apparatus for heating a building airspace with hot air, including the combination of a furnace having a combustion chamber for combusting fuel to produce hot combustion products which contain CO gas, heat exchanger means in the combustion chamber for normally separating the combustion products from a first air flow path and for transferring heat from the combustion products to heat air within said first path, said furnace having an outlet opening with a given cross sectional area through which air in said first path is directed at a first rate of flow out of the furnace, means connected with said outlet opening for providing a plenum chamber for directing air from the first path along a second path within said plenum chamber, said plenum chamber having a cross sectional area which is sized greater than said given cross sectional area in an amount sufficient to cause air to flow within the second path at a second rate which is slower than said first rate, means for directing air from the plenum chamber along a third path for distribution to the building airspace, control circuit means for switching the furnace between an operating mode for burning fuel to produce said combustion products and a non-operating mode in which combustion products are not being produced, sensor means positioned in the second path of hot air in the plenum chamber for sensing the concentration of CO gas therein and for producing an output signal responsive to the concentration of CO gas in the plenum chamber reaching a predetermined level, and means for operating said control circuit for switching the furnace to said non-operating mode responsive to said output signal.

2. A safety control system as in claim 1 in which said control circuit means includes detect cycle means for periodically enabling operation of said gas sensor means in cycles of predetermined time periods.

3. A safety control system as in claim 2 in which said control circuit means controls said CO gas sensor for generating at least once during each time period a probe signal having a value which is a predetermined function of the level of CO gas sensed within the plenum, said control means triggering said output signal only responsive to said probe signal being above a predetermined value which is proportional to said predetermined unsafe magnitude of CO gas concentration.

4. A method for controlling the operation of a hot air furnace to prevent buildup of dangerous concentrations of CO gas within a building airspace being heated by hot air distributed from an air exit plenum which is downstream in the flow of hot air from the furnace, the furnace having a heat exchanger which separates air circulating through the furnace from the furnace's combustion products which contain CO gas, the method including the steps of controlling the furnace in an operating mode by combustion fuel for producing said combustion products, directing hot air from the heat exchanger out of the furnace through an outlet path having a predetermined cross sectional area while causing the air to flow through the outlet path at a first rate, directing hot air from the outlet path through a plenum path having a cross sectional area which is greater than said predetermined cross sectional area while causing air to flow through the plenum path at a second rate which is slower than said first rate of air flow, positioning a CO gas sensor in the plenum path of hot air while said furnace is in its operating mode, operating said sensor to sense CO gas within said plenum path and generating a disable control signal when said CO gas concentration is sensed above a predetermined level, and disabling said furnace control circuit by switching the furnace responsive to said disable control signal into a nonoperating mode in which said fuel combustion is discontinued.

5. A method as in claim 4 in which the disable control signal is generated when the predetermined level of CO gas concentration is above substantially 200 ppm.

6. A method as in claim 4 which includes the step of triggering an audible alarm responsive to said disable control signal.

* * * * *